US006312362B1

(12) United States Patent
Maresh et al.

(10) Patent No.: US 6,312,362 B1
(45) Date of Patent: Nov. 6, 2001

(54) EXERCISE APPARATUS WITH ELLIPTICAL FOOT MOTION

(76) Inventors: Joseph D. Maresh, P.O. Box 645, West Linn, OR (US) 97068-0645; Kenneth W. Stearns, P.O. Box 55912, Houston, TX (US) 77055

( * ) Notice: Subject to any disclaimer, the term of this patent is extended or adjusted under 35 U.S.C. 154(b) by 0 days.

(21) Appl. No.: 09/758,758

(22) Filed: Jan. 11, 2001

(51) Int. Cl.[7] ..... A63B 22/00
(52) U.S. Cl. ..... 482/52; 482/51
(58) Field of Search ..... 482/51, 52, 57, 482/70, 79, 80, 62

(56) References Cited

U.S. PATENT DOCUMENTS 5,921,894 * 7/1999 Eschenbach ..... 482/57
6,024,676 * 2/2000 Eschenbach ..... 482/51
6,142,915 * 11/2000 Eschenbach ..... 482/52
6,168,552 * 1/2001 Eschenbach ..... 482/52
6,248,045 * 6/2001 Stearns et al. .

* cited by examiner

*Primary Examiner*—Stephen R. Crow

(57) ABSTRACT

An exercise apparatus includes a frame; left and right cranks rotatably mounted on the frame; left and right floating cranks rotatably mounted on the cranks; left and right foot supporting links movably interconnected between the floating cranks and the frame; left and right foot platforms pivotally mounted on the foot supporting links; and left and right drawbar links movably interconnected between the cranks and the foot supporting members, and movably connected to the foot platforms. The resulting assembly links rotation of the cranks to generally elliptical movement of the foot platforms, as well as pivoting of the foot platforms relative to the foot supporting links.

4 Claims, 2 Drawing Sheets

Fig. 1
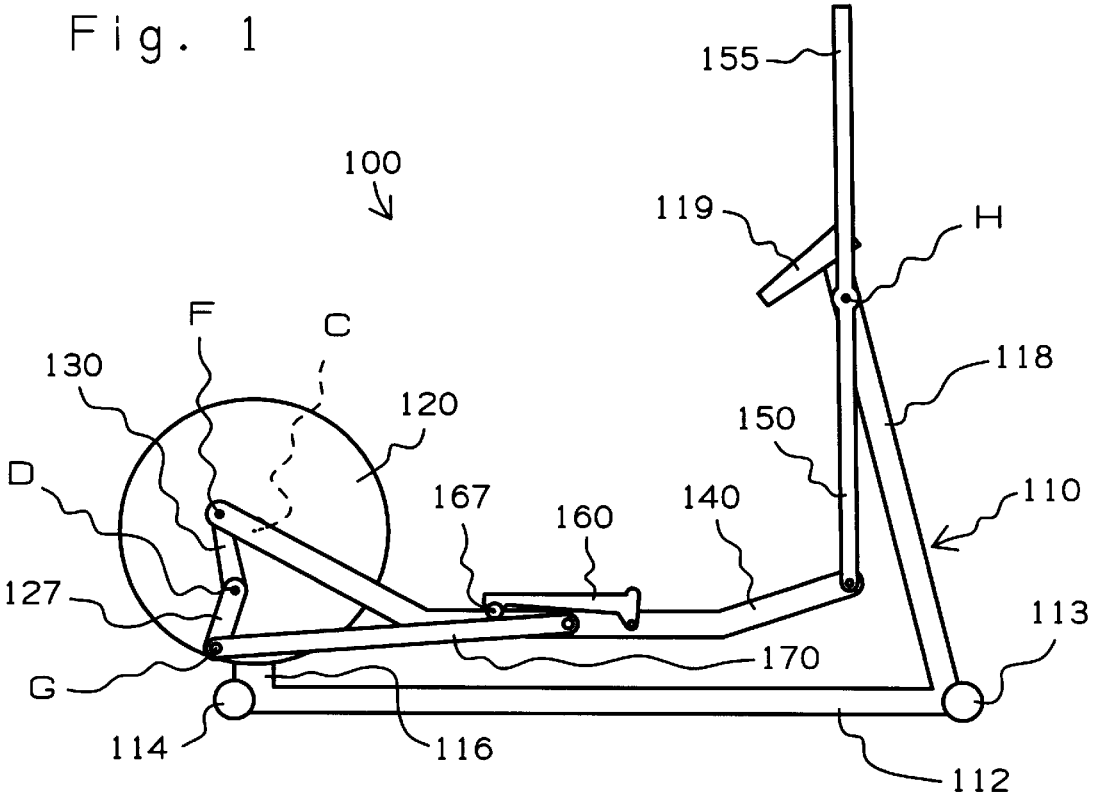
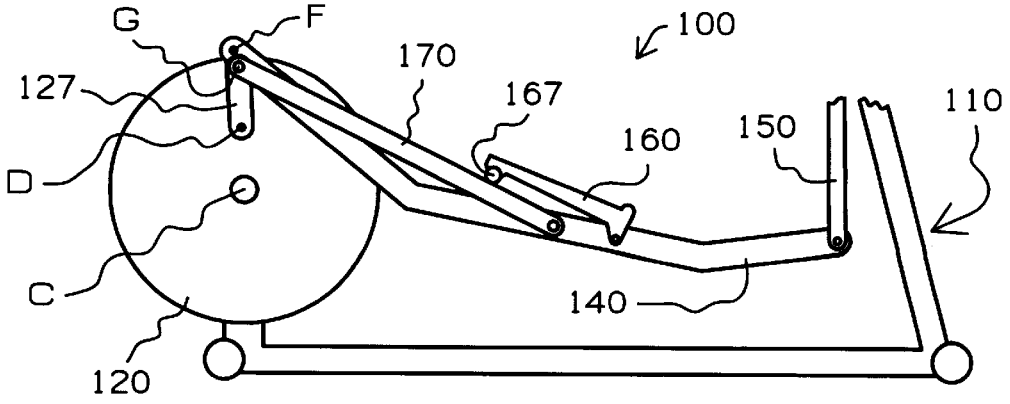
Fig. 2

Fig. 3
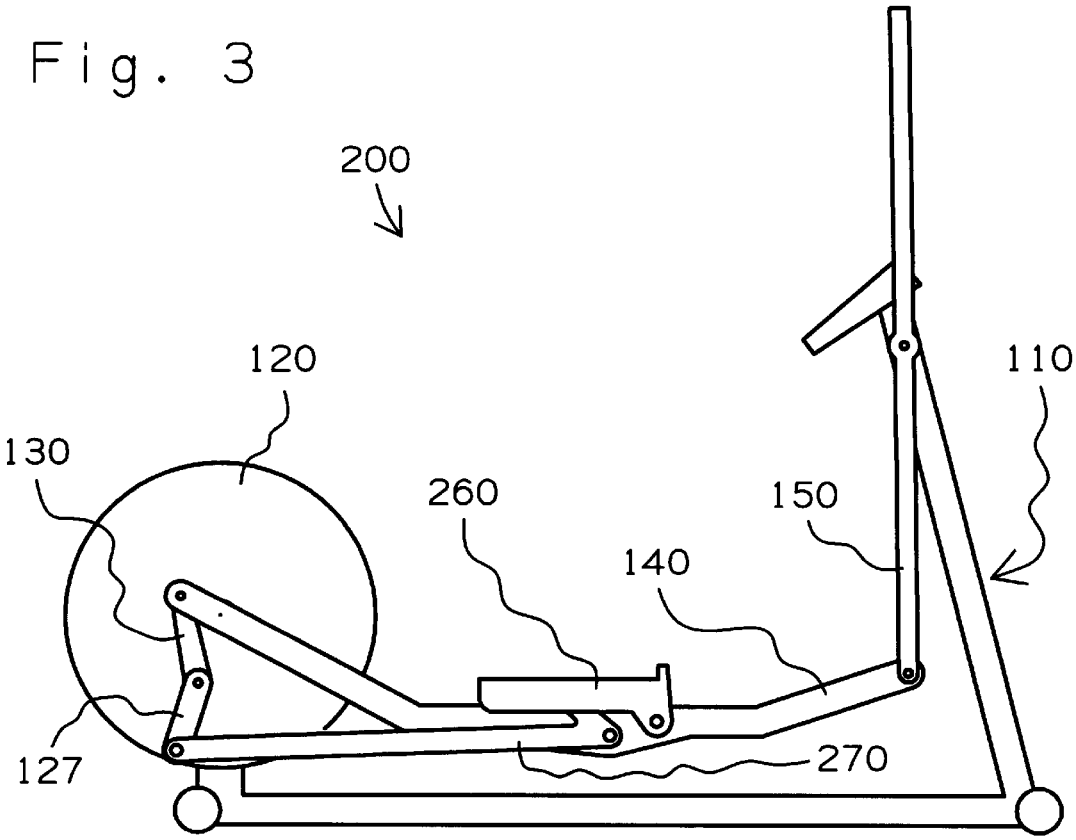
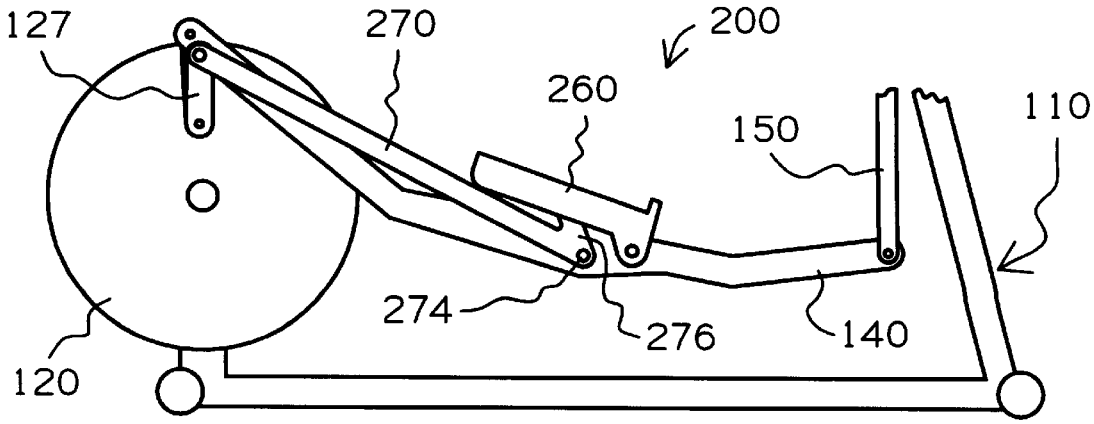
Fig. 4

EXERCISE APPARATUS WITH ELLIPTICAL FOOT MOTION

FIELD OF THE INVENTION

The present invention relates to exercise methods and apparatus and more particularly, to exercise equipment which facilitates movement of a person's feet through generally elliptical paths.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Yet another type of exercise equipment has been designed to facilitate relatively more complicated exercise motions and/or to better simulate real life activity. Such equipment typically uses a linkage assembly to convert a relatively simple motion, such as circular, into a relatively more complex motion, such as elliptical. For example, see U.S. Pat. No. 4,185,622 to Swenson; U.S. Pat. No. 5,279,529 to Eschenbach; U.S. Pat. No. 5,383,829 to Miller; U.S. Pat. No. 5,540,637 to Rodgers, Jr.; and U.S. Pat. No. 5,792,026 to Maresh et al.

SUMMARY OF THE INVENTION

Generally speaking, the present invention provides a novel linkage assembly and corresponding exercise apparatus suitable for linking circular motion to relatively more complex, generally elliptical motion. On a preferred embodiment, left and right cranks are rotatably mounted on a rearward end of a frame, and left and right floating cranks are rotatably mounted on respective cranks. Left and right foot supporting links are movably interconnected between respective floating cranks and a forward end of the frame, and left and right foot platforms are pivotally mounted on intermediate portions of respective foot supporting links. Left and right drawbar links are movably interconnected between respective cranks and respective foot supporting links, and the foot platforms are movably connected respective drawbar links. The resulting assembly causes the foot platforms to move through generally elliptical paths and to pivot relative to respective foot supporting links.

BRIEF DESCRIPTION OF THE DRAWING

With reference to the Figures of the Drawing, wherein like numerals represent like parts and assemblies throughout the several views, FIG. 1 is a side view of a first exercise apparatus constructed according to the principles of the present invention;

FIG. 2 is a side view of the exercise apparatus of FIG. 1, shown at a different point in an exercise cycle;

FIG. 3 is a side view of a second exercise apparatus constructed according to the principles of the present invention; and FIG. 4 is a side view of the exercise apparatus of FIG. 3, shown at a different point in an exercise cycle.

DETAILED DESCRIPTION OF THE PREFERRED EMBODIMENT

A preferred embodiment exercise apparatus constructed according to the principles of the present invention is designated as 100 in FIGS. 1–2. The apparatus 100 includes a linkage assembly movably mounted on a frame 110 in a manner that links rotation of left and right flywheels 120 to generally elliptical motion of left and right foot platforms 160, and/or that links generally elliptical motion of the foot platforms 160 to reciprocal pivoting of left and right rocker links 150. Except for the foot platforms 160, the apparatus 100 is similar to that shown in U.S. Pat. No. 5,792,026, which is incorporated herein by reference.

The frame 110 includes a base 112 that extends from a forward end 113 to a rearward end 114, and is designed to rest upon a generally horizontal floor surface. The apparatus 100 is generally symmetrical about a vertical plane extending lengthwise through the base 112 (perpendicular to the transverse ends 113 and 114 thereof), the only exception being the relative orientation of certain parts of the linkage assembly on opposite sides of the plane of symmetry. Like reference numerals are used to designate both the "right-hand" and "left-hand" parts on the apparatus 100, and when reference is made to parts on only one side of the apparatus, it is to be understood that similar parts are disposed on the opposite side of the apparatus 100. Those skilled in the art will also recognize that the portions of the frame 110 which are intersected by the plane of symmetry exist individually and thus, do not have any "opposite side" counterparts. Furthermore, to the extent that reference is made to "forward" or "rearward" portions of the apparatus 100, it is to be understood that a person could exercise his/her legs on the apparatus 100 while facing in either direction relative to the linkage assembly.

A forward stanchion 118 extends upward from the base 112 proximate the forward end 113 thereof. A user interface 119 is mounted on top of the stanchion 118 to display information to a user and/or receive input from the user, all according to methods that are well known in the art.

A rearward stanchion 116 extends upward from the base 112 proximate the rearward end 114 thereof. The left and right flywheels 120 are rotatably mounted on the stanchion 116 in a manner known in the art. For example, a shaft may be inserted through left and right bearing assemblies, and the flywheels 120 may be rigidly secured to respective protruding ends of the shaft, on opposite sides of the stanchion 116. Those skilled in the art will recognize that the flywheels 120 may be replaced by some other rotating member(s) which may or may not, in turn, be connected to one or more flywheels and/or known resistance devices. In any event, the flywheels 120 rotate about a common crank axis designated as C.

A radially displaced shaft is rigidly secured to each flywheel 120 at a respective point or axis D. The two points D are diametrically opposite one another. Each shaft and its respective flywheel 120 cooperate to define a first crank (CD) having a first crank radius, as measured from point C to point D.

Each crank link or floating link 130 has a first, lower end rotatably connected to a respective shaft at a respective axis D, and a second, upper end rotatably connected to the rearward end of a respective foot supporting link 140 at a respective axis F. In other words, each crank link 130 may be said to be rotatably interconnected between a respective crank (CD) and a respective foot supporting link 140, and/or to provide a means for interconnecting a respective crank (CD) and a respective foot supporting link 140.

Each foot supporting link 140 has a forward end that is movable in reciprocal fashion relative to the frame 110. On the preferred embodiment 100, the forward end of each foot supporting link 140 is rotatably connected to the lower end of a respective rocker link 150. Each rocker link 150 is rotatably connected to the forward stanchion 118 and pivotal about a common pivot axis H. In other words, each rocker link 150 may be said to be rotatably interconnected between a respective foot supporting link 140 and the frame 110, and/or to provide a means for interconnecting a respective foot supporting link 140 and the frame 110. An upper distal portion 155 of each rocker link 150 is sized and configured for grasping, and the handle portions 155 are constrained to pivot back and forth during rotation of the cranks 120.

Each foot platform 160 has a forward end pivotally connected to the intermediate portion of a respective foot supporting link 140. More specifically, each foot platform 160 has opposing flanges that overlap opposite sides of a respective foot supporting link 140, and a bolt is inserted through the overlapping parts and secured in place. An opposite, rearward end of each foot platform 160 supports a respective roller 167 at an outboard location. An intermediate portion of each foot platform 160 is sized and configured to support a respective foot of a standing person.

With reference back to the crank assemblies, a respective crank extension 127 is rigidly secured to each shaft at a respective point D. A respective pin is secured to a radially outward end of each crank extension 127 and extends away from a respective flywheel 120 at a respective point or axis G. The two points G are diametrically opposite one another. Each pin and its respective flywheel 120 cooperate to define a second crank (CG) having a second crank radius, as measured between points C and G. Among other things, the second crank (CG) and the first crank (CD) may be described as integrally connected and constrained to rotate together about the common crank axis C.

A rearward end of each drawbar link 170 is rotatably connected to a respective pin at a respective axis G. An opposite, forward end of each drawbar link 170 is rotatably connected to an intermediate portion of a respective foot supporting link 140, beneath an intermediate portion of a respective foot platform 160. In other words, each drawbar link 170 may be said to be rotatably interconnected between a respective crank (CG) and a respective foot supporting link 140, and/or to provide a discrete means for interconnecting a respective crank (CG) and a respective foot supporting link 140. The roller 167 on each foot platform 160 rests on top of a respective drawbar link 170.

As a result of the arrangement described above, rotation of the flywheels 120 is linked to generally elliptical movement of the foot platforms 160 and to reciprocal pivoting of the rocker links 150. The vertical component or minor axis of the foot path is a function of (1) the crank diameter defined between the two diametrically opposed points D, and (2) the vertical displacement of the forward end of the foot supporting links 140. The horizontal component or major axis of the foot path is a function of (1) the crank diameter defined between the two diametrically opposed points G, and (2) the horizontal displacement of the forward end of the foot supporting links 140. Given this general relationship between crank radii and components of motion, it is a relatively simple matter to provide the apparatus 100 with a desired "aspect ratio" for the elliptical path to be traveled by the foot platforms 160.

As shown in FIG. 2, the drawbar 170 is configured and arranged to cause the rearward end of the foot platform 160 to pivot upward during an interval of forward foot travel, and as shown in FIG. 1, the drawbar 170 causes the rearward end of the foot platform 160 to pivot downward (or level out) during an interval of rearward foot travel. The nature of the pivoting of the foot platform 160, in terms of timing, duration, and magnitude, for example, may be altered by changing the shape of the members 160 and 170 and/or the relative positions of the members 160 and 170 and/or their respective pivot axes.

Although the present invention has been described with reference to a preferred embodiment and a particular application, those skilled in the art will recognize additional embodiments and/or applications which nonetheless fall within the scope of the present invention. For example, different "foot pivoting" arrangements may be provided, as suggested by the alternative embodiment exercise apparatus designated as 200 in FIGS. 3–4. As suggested by the common reference numerals, the apparatus 200 is similar to the apparatus 100 except for the manner in which the foot platforms 260 are linked to respective drawbar links 270. On each side of the apparatus 200, a shaft 274 is rotatably mounted on a respective foot supporting link 140, and both the drawbar link 270 and two opposing cams 276 are rigidly secured to the shaft 274. The two cams 276 are secured to opposite ends of the shaft and project upward into contact with the underside of a respective foot support 260. Each of the foot supports 260 has an inverted U-shaped profile with opposite sides extending downward and spaced apart to straddle the other linkage components.

Those skilled in the art will recognize that the foregoing disclosure may be referenced to describe a variety of methods and apparatus. For example, the present invention may be described in terms of an exercise apparatus, comprising a frame having a base that extends from a front end to a rear end and is designed to rest upon a floor surface; a left crank and a right crank, wherein each said crank is rotatably mounted on said frame and rotatable about a common crank axis; a left crank link and a right crank link, wherein each said crank link has a first end and a second end, and each said first end is rotatably connected to a respective crank at a respective position radially displaced from said crank axis; a left foot supporting link and a right foot supporting link, wherein each said foot supporting link has a rearward end rotatably connected to said second end of a respective crank link, and a forward end movably connected to said frame; a left foot platform and a right foot platform, wherein each said foot platform is pivotally mounted on an intermediate portion of a respective foot supporting link; and a left drawbar link and a right drawbar link, wherein each said drawbar link has a first end rotatably connected to an intermediate portion of a respective foot supporting link, a second end rotatably connected to a respective crank at a respective position radially displaced from said crank axis, and an intermediate portion movably connected to a distal end of a respective foot platform, wherein each said drawbar link causes a respective foot platform to pivot relative to a respective foot supporting link during rotation of a respective crank. Each said crank link may be connected to a respective crank at a first radius from said crank axis, and each said drawbar link may be connected to a respective crank at a second, relatively greater radius from said crank axis. A left rocker link may be rotatably interconnected between said frame and said forward end of said left foot supporting link, and a right rocker link is rotatably interconnected between said frame and said forward end of said right foot supporting link, in which case an upper distal end of each said rocker link may be sized and configured for grasping. A forward end of each said foot platform may be rotatably mounted on a respective foot supporting link, in which case, each said drawbar link may be connected to a respective foot supporting link at a location beneath an intermediate portion of a respective foot platform.

The present invention may also be described in terms of an exercise apparatus, comprising a frame having a base that extends from a front end to a rear end and is designed to rest upon a floor surface; a left crank and a right crank, wherein each said crank is rotatably mounted on said frame and rotatable about a common crank axis; a left crank link and a right crank link, wherein each said crank link has a first end and a second end, and each said first end is rotatably connected to a respective crank at a respective position radially displaced from said crank axis; a left foot supporting link and a right foot supporting link, wherein each said foot supporting link has a rearward end rotatably connected to said second end of a respective crank link, and a forward end movably connected to said frame; a left foot platform and a right foot platform, wherein each said foot platform is pivotally mounted on an intermediate portion of a respective foot supporting link; a left drawbar link and a right drawbar link, wherein each said drawbar link has a first end rotatably connected to an intermediate portion of a respective foot supporting link, and a second end rotatably connected to a respective crank at a respective position radially displaced from said crank axis; and a left pivoting means and a right pivoting means, each for pivoting a respective foot platform relative to a respective foot supporting link during rotation of a respective crank. Among other things, each pivoting means may be a portion of a respective foot platform resting on a respective drawbar link, or a portion of a respective drawbar bearing against a respective foot platform.

Generally speaking, each of the linkage components on the present invention must be sufficiently long to facilitate the necessary interconnections, and for ease of reference, the components are sometimes described with reference to "ends" being connected to other parts. However, those skilled in the art will recognize that the present invention is not limited to links which terminate immediately beyond their points of connection with other parts, and the term "end" should be interpreted broadly, in a manner that could include "rearward portion" and/or "behind an intermediate portion", for example. In conclusion, the scope of the present invention is to be limited only to the extent of the claims which follow.

What is claimed is:

1. An exercise apparatus, comprising:

a frame having a base that extends from a forward end to a rearward end and is designed to rest upon a floor surface;

a left flywheel and a right flywheel, wherein each said flywheel is rotatably mounted on a rearward stanchion extending upward from said base proximate said rearward end, and each said flywheel is rotatable about a common crank axis;

a left floating crank link and a right floating crank link, wherein each said floating crank link has a lower end and an upper end, and each said lower end is rotatably connected to a respective flywheel at a respective position radially displaced from said crank axis;

a left rocker link and a right rocker link, wherein each said rocker link is pivotally mounted on a forward stanchion extending upward from said base proximate said forward end, and each said rocker link pivots about a common pivot axis;

a left foot supporting link and a right foot supporting link, wherein each said foot supporting link has a rearward end rotatably connected to the upper end of a respective floating crank link, and a forward end pivotally connected to a lower end of a respective rocker link;

a left drawbar link and a right drawbar link, wherein each said drawbar link has a forward end rotatably connected to an intermediate portion of a respective foot supporting link, and a rearward end rotatably connected to a respective flywheel at a respective position radially displaced from said crank axis; and a left foot platform and a right foot platform, wherein each said foot platform has a forward end pivotally mounted on an intermediate portion of a respective foot supporting link, and a rearward end resting on an intermediate portion of a respective drawbar link in such a manner that each said drawbar link causes a respective foot platform to pivot relative to a respective foot supporting link during rotation of a respective flywheel.

2. The exercise apparatus of claim 1, wherein each said floating crank link is connected to a respective flywheel at a first radius from said crank axis, and each said drawbar link is connected to a respective flywheel at a second, relatively greater radius from said crank axis.

3. The exercise apparatus of claim 1, wherein an upper distal end of each said rocker link is sized and configured for grasping.

4. The exercise apparatus of claim 1, wherein each said drawbar link is connected to a respective foot supporting link at a location beneath an intermediate portion of a respective foot platform.

* * * * *